US006814318B2

(12) United States Patent
Wilson et al.

(10) Patent No.: US 6,814,318 B2
(45) Date of Patent: Nov. 9, 2004

(54) DISPOSABLE CARTRIDGE FOR ELECTROSTATIC SPRAY DEVICE

(75) Inventors: David Edward Wilson, Reisterstown, MD (US); Bryan Michael Kadlubowski, Manchester, MD (US); Jeffrey Keith Leppla, Baltimore, MD (US); Toru Sumiyoshi, Ashiya (JP)

(73) Assignee: The Procter & Gamble Company, Cincinnati, OH (US)

( * ) Notice: Subject to any disclaimer, the term of this patent is extended or adjusted under 35 U.S.C. 154(b) by 302 days.

(21) Appl. No.: 09/759,549

(22) Filed: Jan. 12, 2001

(65) Prior Publication Data

US 2001/0023902 A1 Sep. 27, 2001

Related U.S. Application Data

(63) Continuation-in-part of application No. 09/377,332, filed on Aug. 18, 1999, now Pat. No. 6,318,647, which is a continuation-in-part of application No. 09/377,333, filed on Aug. 18, 1999, now Pat. No. 6,311,903.

(51) Int. Cl.[7] ..... B05B 5/00

(52) U.S. Cl. ..... 239/690; 239/690.1; 239/691; 239/692; 239/706; 239/708

(58) Field of Search ..... 239/690, 690.1, 239/691, 692, 693, 694, 695, 696, 697, 698, 699, 700, 701, 702, 703, 704, 705, 706, 707, 708

(56) References Cited

U.S. PATENT DOCUMENTS

| | | | |
|---|---|---|---|
| 2,159,894 A | 5/1939 | Hines | 299/89 |
| 2,629,516 A | 2/1953 | Badham | 222/79 |
| 3,012,969 A | 12/1961 | van der Minne et al. | 252/153 |

(List continued on next page.)

FOREIGN PATENT DOCUMENTS

| | | | |
|---|---|---|---|
| BE | 868443 | 12/1978 | |
| BE | 882449 | 7/1980 | |
| BE | 882450 | 7/1980 | |
| EP | 0 057 324 A | 8/1982 | |
| EP | 096 731 A1 | 12/1983 | A61N/1/04 |
| EP | 523 960 A1 | 1/1993 | B05D/1/04 |
| EP | 523 961 A1 | 1/1993 | B05D/1/04 |
| EP | 523 962 A1 | 1/1993 | B05D/1/04 |
| EP | 523 963 A1 | 1/1993 | B05D/1/04 |
| EP | 523 964 A1 | 1/1993 | B05D/1/04 |
| EP | 544 158 | 6/1993 | C08F/26/06 |
| FR | 2127433 | 9/1972 | |
| GB | 2 128 900 A | 5/1984 | B05B/5/06 |
| GB | 2 273 673 A | 6/1994 | B05B/5/025 |
| GB | 2 273 872 A | 7/1994 | B05B/5/025 |
| JP | 10-146216 | 6/1998 | A45D/33/38 |

(List continued on next page.)

*Primary Examiner*—Robin O. Evans
(74) *Attorney, Agent, or Firm*—Jack L. Oney, Jr.; Dara M. Kendall

(57) ABSTRACT

An electrostatic spraying device being configured and disposed to electrostatically charge and dispense a product from a supply to a point of dispersal. This device has a reservoir configured to contain the supply of product and a nozzle to disperse the product. A channel is disposed between the reservoir and the nozzle, wherein the channel permits the electrostatic charging of the product upon the product moving within the channel. A positive displacement mechanism is used to move the product from the reservoir to the nozzle. A portion of the high voltage electrode being disposed between the reservoir and the nozzle is used to electrostatically charge the product within the channel at a charging location. A mixing mechanism may be disposed between the reservoir and the nozzle to reconstitute any product which may have separated. The high voltage contact may be spring biased in direction towards the high voltage electrode. The high voltage electrode may be annular to improve contact with the high voltage contact.

13 Claims, 11 Drawing Sheets

U.S. PATENT DOCUMENTS

| | | | | | |
|---|---|---|---|---|---|
| 4,000,443 | A | | 12/1976 | Lever | |
| 4,079,894 | A | | 3/1978 | Harjar et al. | 239/526 |
| 4,122,845 | A | | 10/1978 | Stouffer et al. | 128/66 |
| 4,143,819 | A | | 3/1979 | Hastings | 239/707 |
| 4,194,696 | A | | 3/1980 | Harjar | 239/707 |
| 4,258,073 | A | | 3/1981 | Payne | 427/1 |
| 4,331,298 | A | | 5/1982 | Bentley et al. | |
| 4,549,243 | A | | 10/1985 | Owen et al. | |
| 4,561,037 | A | | 12/1985 | MacLaine et al. | 361/228 |
| 4,577,803 | A | | 3/1986 | Owen | 239/690 |
| 4,907,727 | A | | 3/1990 | Ernst et al. | 222/386.5 |
| 4,971,257 | A | * | 11/1990 | Birge | 239/708 |
| 5,105,984 | A | | 4/1992 | Kazimir | 222/103 |
| 5,221,050 | A | | 6/1993 | Jeffries et al. | 239/708 |
| 5,222,663 | A | | 6/1993 | Noakes et al. | 239/3 |
| 5,229,105 | A | | 7/1993 | Wilmsmann | 424/59 |
| 5,268,166 | A | | 12/1993 | Barnett et al. | 424/47 |
| 5,292,067 | A | | 3/1994 | Jeffries et al. | 239/3 |
| 5,296,681 | A | | 3/1994 | Tschauder | 219/410 |
| 5,322,684 | A | | 6/1994 | Barnett et al. | 424/47 |
| 5,405,090 | A | | 4/1995 | Greene et al. | 239/708 |
| 5,422,630 | A | | 6/1995 | Quinn et al. | 340/661 |
| 5,468,488 | A | | 11/1995 | Wahi | 424/78.03 |
| 5,490,633 | A | | 2/1996 | Jeffries et al. | 239/691 |
| 5,494,674 | A | | 2/1996 | Barnett et al. | 424/401 |
| 5,519,159 | A | | 5/1996 | Narabe et al. | 558/169 |
| 5,531,384 | A | | 7/1996 | Greene et al. | |
| 5,662,890 | A | | 9/1997 | Punto et al. | 424/59 |
| 5,674,481 | A | | 10/1997 | Wahi | 424/78.03 |
| 5,732,884 | A | | 3/1998 | Jauner | 239/288.3 |
| 6,079,634 | A | * | 6/2000 | Noakes et al. | 239/690 |
| 6,216,966 | B1 | * | 4/2001 | Prendergast et al. | 239/690 |
| 6,254,684 | B1 | * | 7/2001 | Borner et al. | 239/697 |

FOREIGN PATENT DOCUMENTS

| | | | |
|---|---|---|---|
| SU | 867927 | 9/1981 | C14B/1/54 |
| WO | 94/11119 | 5/1994 | B05D/1/04 |
| WO | 94/27560 | 12/1994 | A61K/7/02 |
| WO | 95/29758 | 11/1995 | B05B/5/025 |
| WO | 96/10459 | 4/1996 | B05B/5/057 |
| WO | 96/11062 | 4/1996 | B05B/5/053 |
| WO | 96/40441 | 12/1996 | B05B/5/025 |
| WO | 97/33527 | 9/1997 | A61B/19/00 |
| WO | 98/18561 | 5/1998 | B05B/5/025 |

* cited by examiner

DISPOSABLE CARTRIDGE FOR ELECTROSTATIC SPRAY DEVICE

CROSS-REFERENCE TO RELATED APPLICATION

This application is a continuation-in-part of our earlier applications, U.S. Ser. No. 09/377,332, filed on Aug. 18, 1999, now U.S. Pat. No. 6,318,647, and U.S. Ser. No. 09/377,333, filed on Aug. 18, 1999, now U.S. Pat. No. 6,311,903.

TECHNICAL FIELD OF INVENTION

This invention relates to a disposable cartridge for a portable electrostatic spray device designed for personal use. More particular, this invention is focused on improvements for product mixing and maintaining a superior high voltage connection.

BACKGROUND OF THE INVENTION

In U.S. Pat. No. 4,380,786, Kelly offers a refillable reservoir system. However, the system described by Kelly does not integrally include a nozzle with the delivery system. The system, as described, would cross contaminate the liquid delivery system when it would be desired to use multiple liquids as Kelly's delivery system is simply a piston operated pump with a dip tube extending into the product reservoir. To avoid cross-contamination this system would necessitate an added cleaning step with a specialized cleaning solution. Furthermore, Kelly does not include a positive displacement system. Rather, Kelly has a non-continuous delivery system in that fluid is delivered in response to user actuation of lever arm 266. As such, Kelly's flow rate will be variable because the rate at which the lever is depressed may vary due to inconsistent actuation force from the user. Kelly's system also does not recognize the need and therefore does not offer a solution to limiting electrical current passing through the product reservoir. Lastly, Kelly does not offer a means by which to mix the product in the reservoir.

In U.S. Pat. No. 6,079,634, Noakes offers a disposable reservoir system. The Noakes system is not a "clean" design, as the electrode stays connected with the device and would be a common element for all reservoirs in communication with the device. Noakes' electrode is a source for cross-contamination between products from different reservoirs. Further, Noakes' electrode design is a thin metal wire, which has an increased breakage potential. Further, the system described by Noakes is a non-continuous delivery system. Further, Noakes does not recognize or offer a solution for the problem of limiting electrical current passing through the product reservoir. Further, Noakes does not offer a method to incorporate a mixing feature in the reservoir to mix product. Finally, Noakes does not address the problem of removing or re-using a partially filled reservoir. With the reservoir being punctured by the electrode, removal of a partially filled reservoir may be messy. Further, when the partially filled reservoir is desired for use again, one would need to align the electrode with the previous puncture site, or create a different puncture and then devise a way to prevent product leakage from the previous puncture site.

SUMMARY OF THE INVENTION

A disposable cartridge for an electrostatic spraying device which is configured and disposed to electrostatically charge and dispense a product from a supply to a point of dispersal. The electrostatic spraying device has a reservoir configured to contain the supply of product and a nozzle to disperse the product. The nozzle being disposed at the point of dispersal. The nozzle has an exit orifice. A channel is disposed between the reservoir and the nozzle, wherein the channel permits the electrostatic charging of the product upon the product moving within the channel. A positive displacement mechanism is used to move the product from the reservoir to the nozzle. A power source supplies an electrical charge. A high voltage power supply, high voltage contact, and high voltage electrode are used. A portion of the high voltage electrode being disposed between the reservoir and the nozzle is used to electrostatically charge the product within the channel at a charging location. A mixing mechanism may be disposed between the reservoir and the nozzle to reconstitute any product which may have separated. The mixing mechanism may be a mixing ball, static mixer, disc having at least one hole, baffle having at least one opening, prop mixer.

The high voltage contact may be spring biased in direction towards the high voltage electrode. The high voltage electrode may be annular to improve contact with the high voltage contact. A locking mechanism may be added to secure the connection between the high voltage contact and the high voltage electrode. A locking feature may be added to secure the disposable cartridge within the device. An ejection feature may be added to release the disposable cartridge from the device.

BRIEF DESCRIPTION OF THE DRAWINGS

While the specification concludes with claims particularly pointing out and distinctly claiming the present invention it is believed that the same will be better understood from the following description, taken in conjunction with the accompanying drawings, in which:

DETAILED DESCRIPTION OF THE PREFERRED EMBODIMENTS

Figure 1:
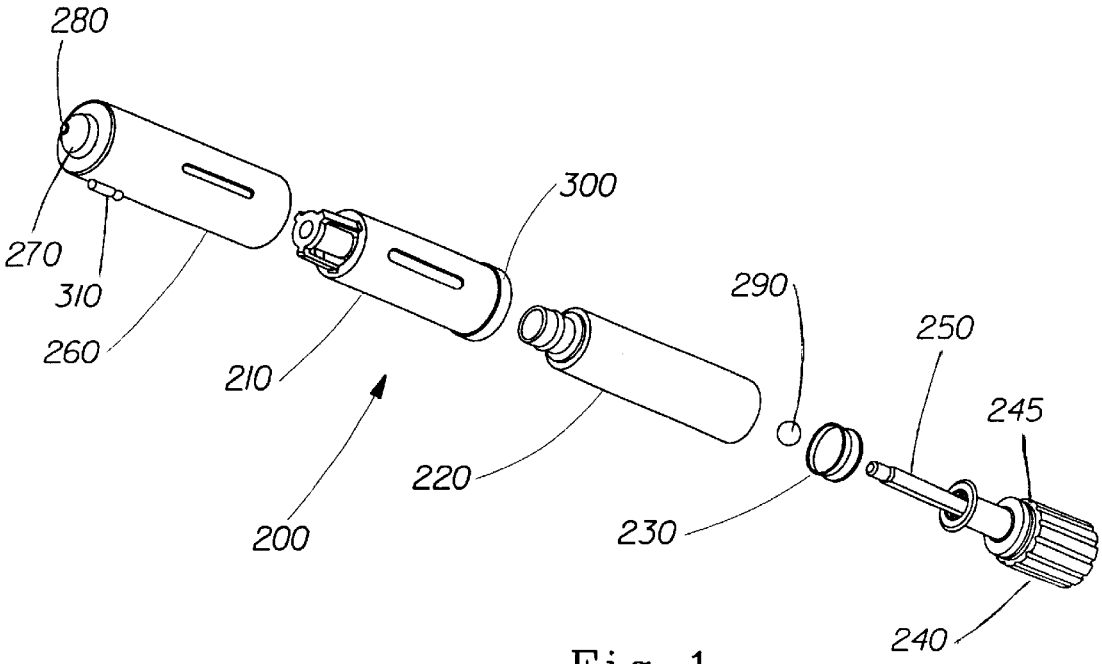
FIG. 1 is an exploded isometric view of a disposable cartridge for a hand-held, self-contained electrostatic spraying device.
Figure 2:
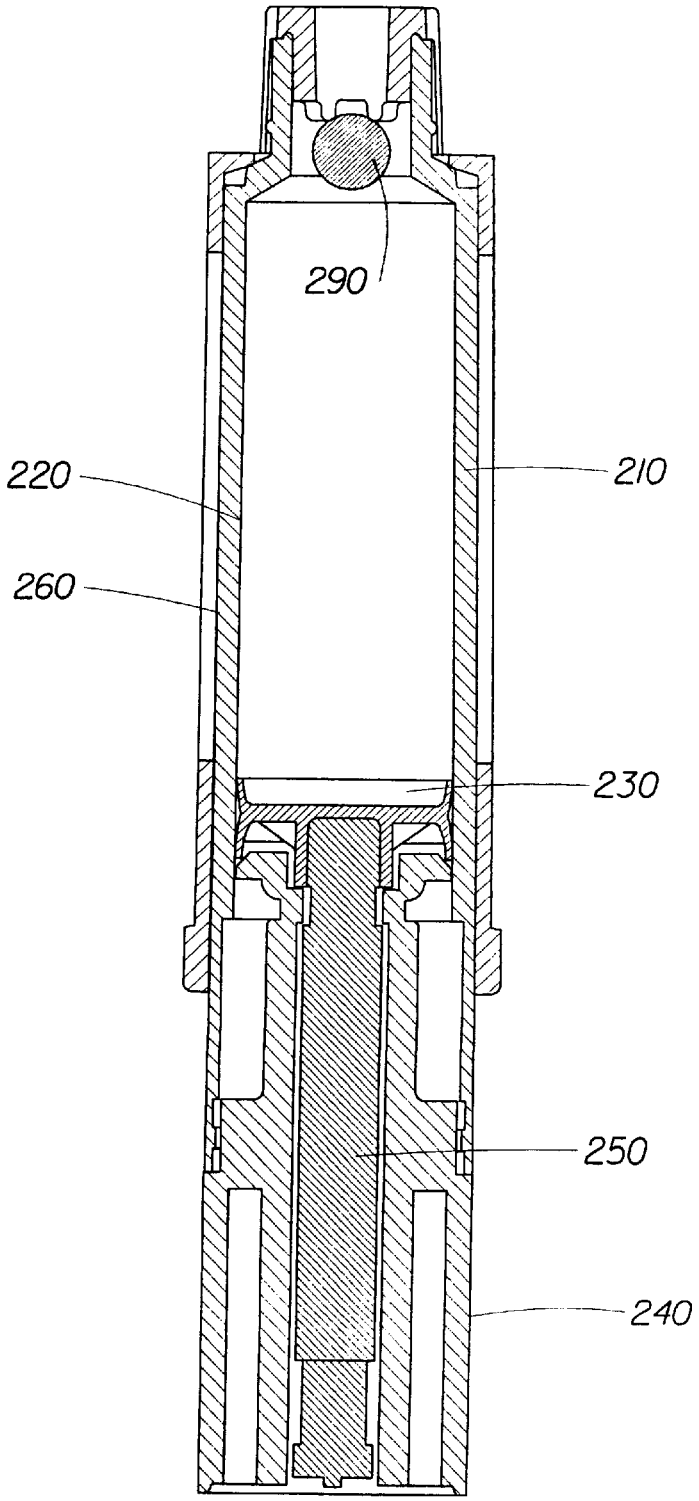
FIG. 2 is a cross-sectional view of the disposable cartridge within FIG. 1.

Referring to FIGS. 1 and 2, a hand-held, self-contained electrostatic spraying device 5 having a disposable cartridge 200 is shown. Disposable cartridge 200 may contain a variety of product, including but not limited to, cosmetics, skin creams, and skin lotions. The product in disposable cartridge 200 may be positively displaced (discussed infra) and powered by gearbox/motor component 10. Gearbox/motor component 10 may be fixed onto a left or first housing 30. The gearbox/motor component 10 can be affixed into place mechanically, adhesively, or by any other suitable technique. Gearbox/motor component 10 preferably comprises a precision motor 10*a* connected to a gearbox 10*b*. Power source 20 provides power to the device. An example of a suitable power source 20 includes, but is not limited to, two "AAA" type batteries. The power source 20 provides power to the device through the control circuit 60, the high voltage power supply 40, and then the high voltage contact 50, which contacts the disposable cartridge 200. High voltage power supply 40 is powered and controlled by control circuit 60 (discussed infra). Power-on switch 80 permits the user to cause an interruption between power source 20 and circuit control 60. Power-on switch 80 is designed such that voltage is supplied to the remainder of the circuit only when switch 80 is in the "ON" or closed position. Apply switch 70 permits the user to selectively activate motor 10*a*, thereby activating the delivery and spraying of the product. Gearbox/motor component 10 has a driver 90 fastened to a shaft (not shown in FIGS. 1 & 2, see FIG. 3) of gearbox 10*b*, for example, with a set screw (not shown). Driver 90 has a number of protruding fingers, for example, three, which can fit into the matching recesses on the back of actuator 240.

Alternatively, the product reservoir 220 may be formed of a conductive material and used to maintain the product reservoir at a high potential instead of having a separate conductive shield around the reservoir 220. A cartridge insulator 260 can prevent discharge from the conductive product reservoir 220 to points having a lower potential that are in close proximity to the product reservoir 220. The product reservoir 220 can be molded of an electrically conductive material plastic such as acrylonitrile butadiene styrene (ABS) filled with 10% carbon fibers. The cartridge insulator 260 provides an insulating cover to prevent discharge from the conductive product reservoir 220 to objects within the device having lower electrical potentials. In this embodiment, the conductive shield 210 is not required.

A first aspect of this invention relates to a means of mechanically mixing and re-suspending separated material within either product reservoir 220 or within the subsequent product delivery pathway. In a first embodiment, as exampled in FIG. 2, one or more mixing balls 290 are placed within product reservoir 220. Disposable cartridge 200 is then shaken by the operator which causes mixing ball 290 to move within product reservoir 220. The movement of mixing ball 290 within product reservoir 220 achieves turbulent mixing of the product within product reservoir 220, thereby reconstituting any separated product. It may be appreciated that the shaking of disposable cartridge 200 may occur while it is either inside or outside of the intended electrostatic spraying device.

Figure 3:
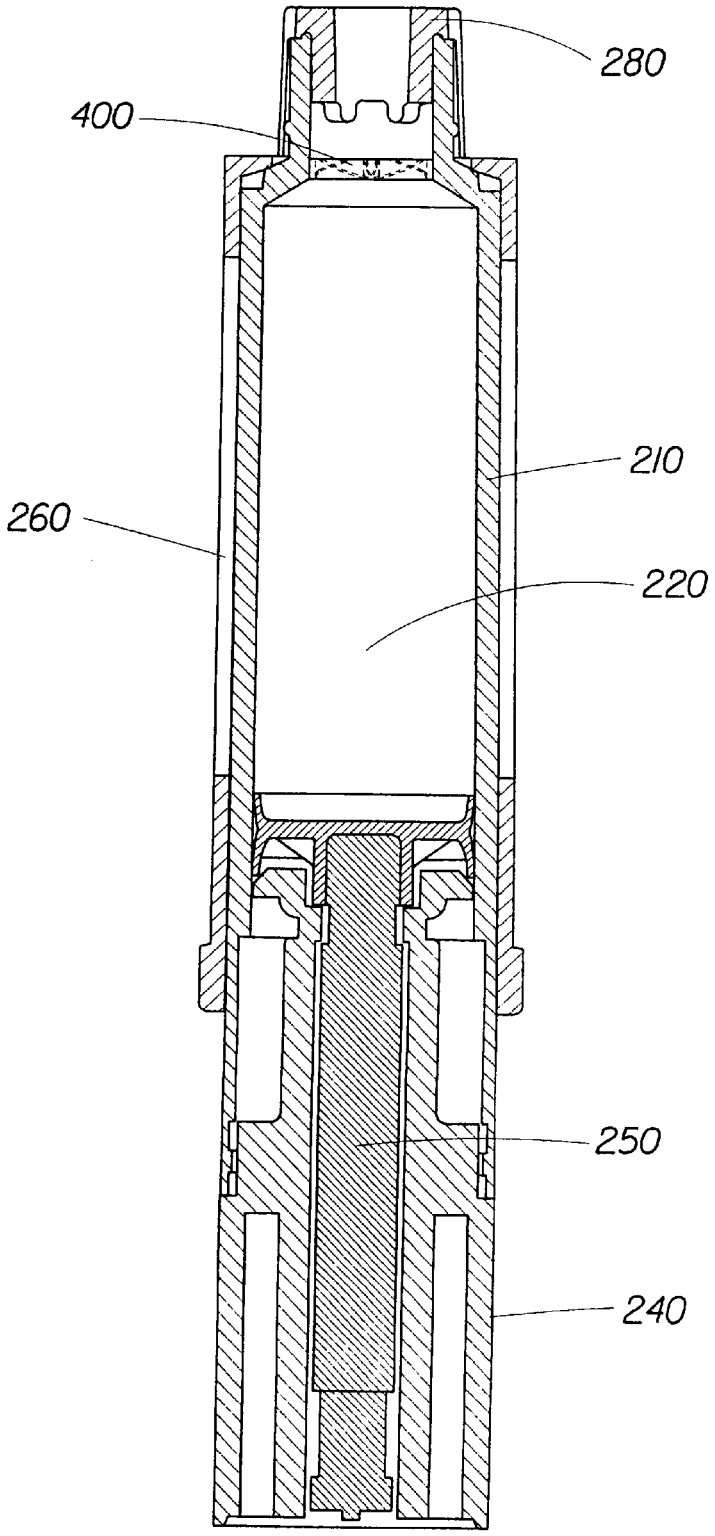
FIG. 3 is a cross-sectional view of a disposable cartridge having a static mixer.
Figure 4:
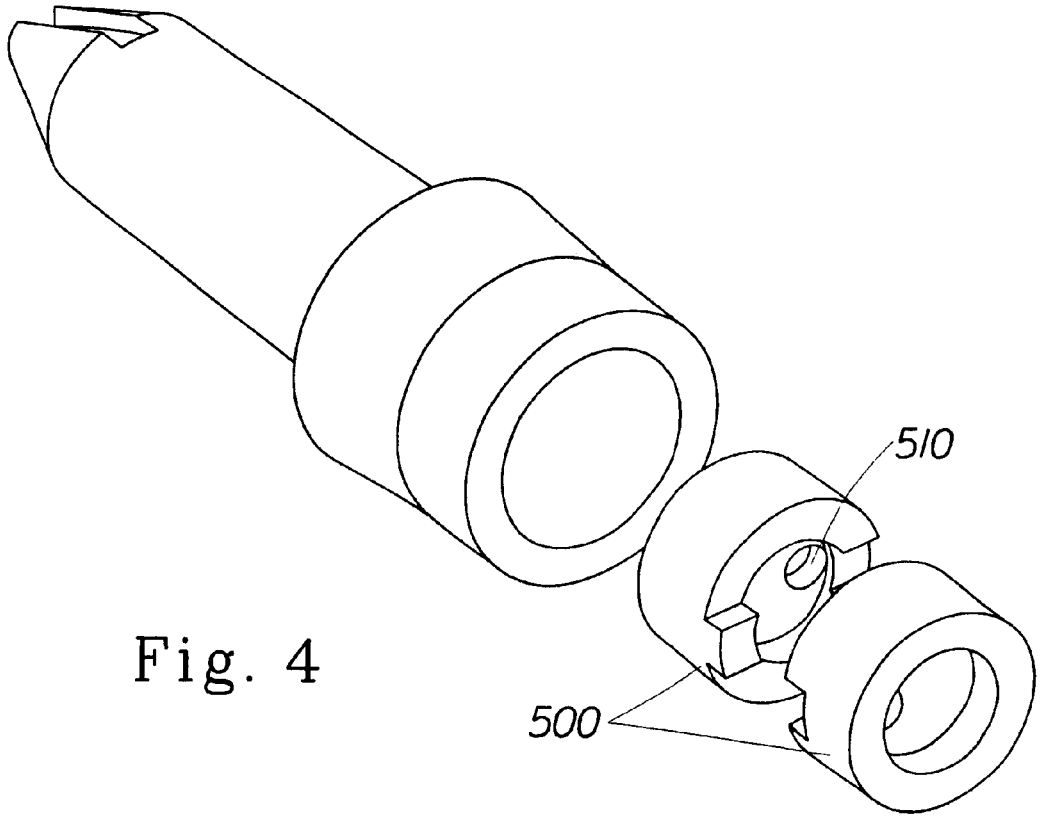
FIG. 4 is an isometric view of a disposable cartridge having at least one disc for increasing turbulent mixing.
Figure 5:
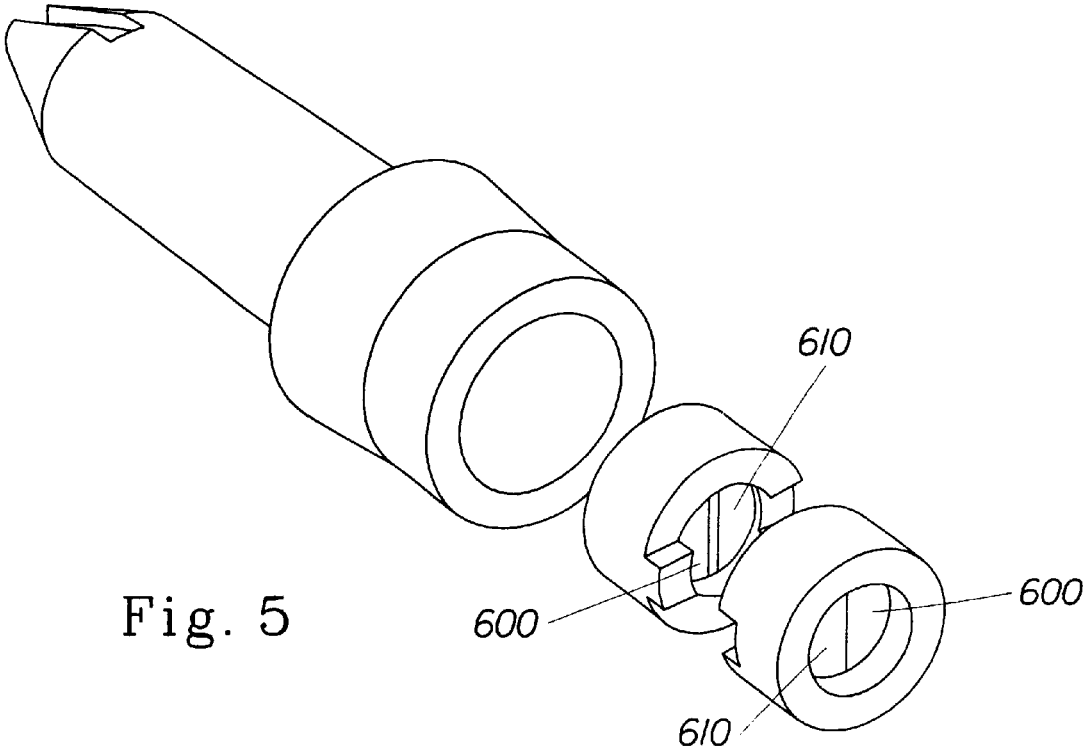
FIG. 5 is an isometric view of a disposable cartridge having at least one baffle for increasing turbulent mixing.

In yet another embodiment that provides for product mixing, as exampled in FIG. 3, a static mixer 400 is placed in fluid communication between product reservoir 220 and nozzle exit orifice 280. Static mixer 400 is designed such that it creates a high degree of turbulent mixing within the fluid flow path in comparison to a straight fluid flow path. The turbulent mixing achieved within the fluid flow path should reconstitute any separated product. Static mixers 400 include, but are not limited to:

1. a helical type structure, as exampled in FIG. 3, although other geometries may be appreciated;
2. at least one disc 500, as exampled in FIG. 4, having at least one hole 510. Disc 500 being inserted within the product flow path. A plurality of discs 500 may be inserted, and more preferably with their holes 510 not being in axial alignment in order to increase turbulent mixing. It may be appreciated that one skilled in the art may change the diameter of holes 510, the location of holes 510, and/or the number of holes 510 in order to alter the degree of turbulent mixing. The diameter of hole 510 in the embodiment of FIG. 4 is approximately 0.030" diameter.
3. at least one baffle 600, as exampled in FIG. 5, having at least one opening 610. Baffle 600 being inserted within the product flow path. A plurality of baffles 600 may be inserted, more preferably with their openings 610 not being in axial alignment in order to increase turbulent mixing. It may be appreciated that one skilled in the art may change the change the size of baffles 610, the location of baffles 610, and/or the number of baffles 610 in order to alter the degree of turbulent mixing.

Figure 6:
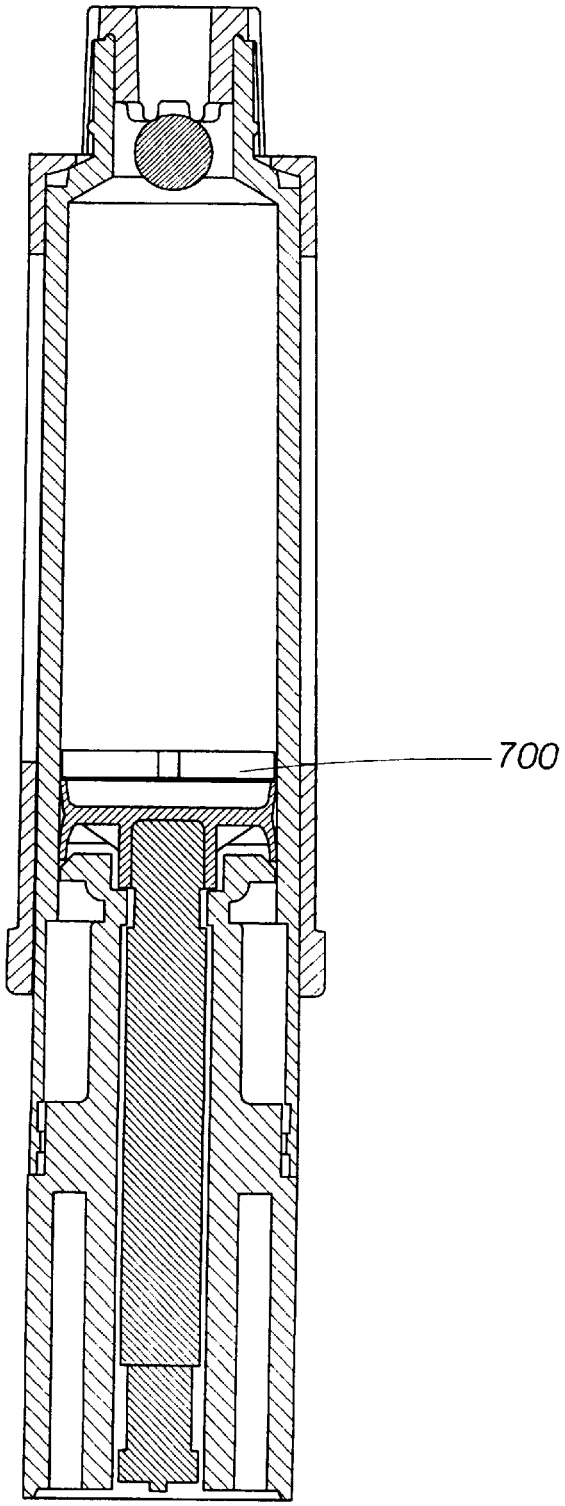
FIG. 6 is a cross-sectional view of a disposable cartridge having a prop mixer.
Figure 11:
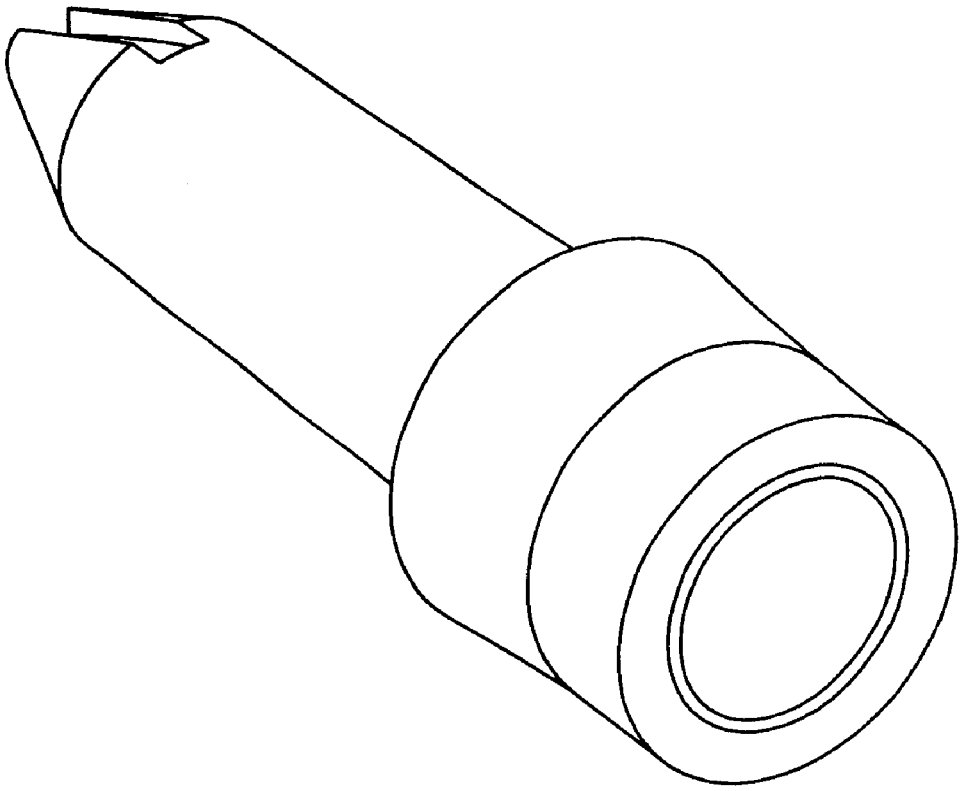
FIG. 11 is an isometric view of a disposable cartridge having a prop mixer which is unattached.

In yet another embodiment, as exampled in FIGS. 6 and 11, a prop mixer 700 is added within product reservoir 220 in order to provide product mixing. Prop mixer 700 may take the form of a paddle connected to piston 230. As piston 230 rotates up or down, so does prop mixer 700, thereby creating turbulent mixing within product reservoir 220. It may also be appreciated by one skilled in the art that such prop mixer 700 need not necessarily be attached to a piston 230. Such alternative configurations include, but are not limited to:

1. prop mixer 700 being attached to another rotating member (e.g. threaded shaft 250) within either the product reservoir 220 or subsequent product delivery pathway; or
2. prop mixer 700 is unattached but yet still contained in said disposable so as to allow prop mixer 700 to rotate about a longitudinal axis to said disposable cartridge in response to product flow.

Figure 7:
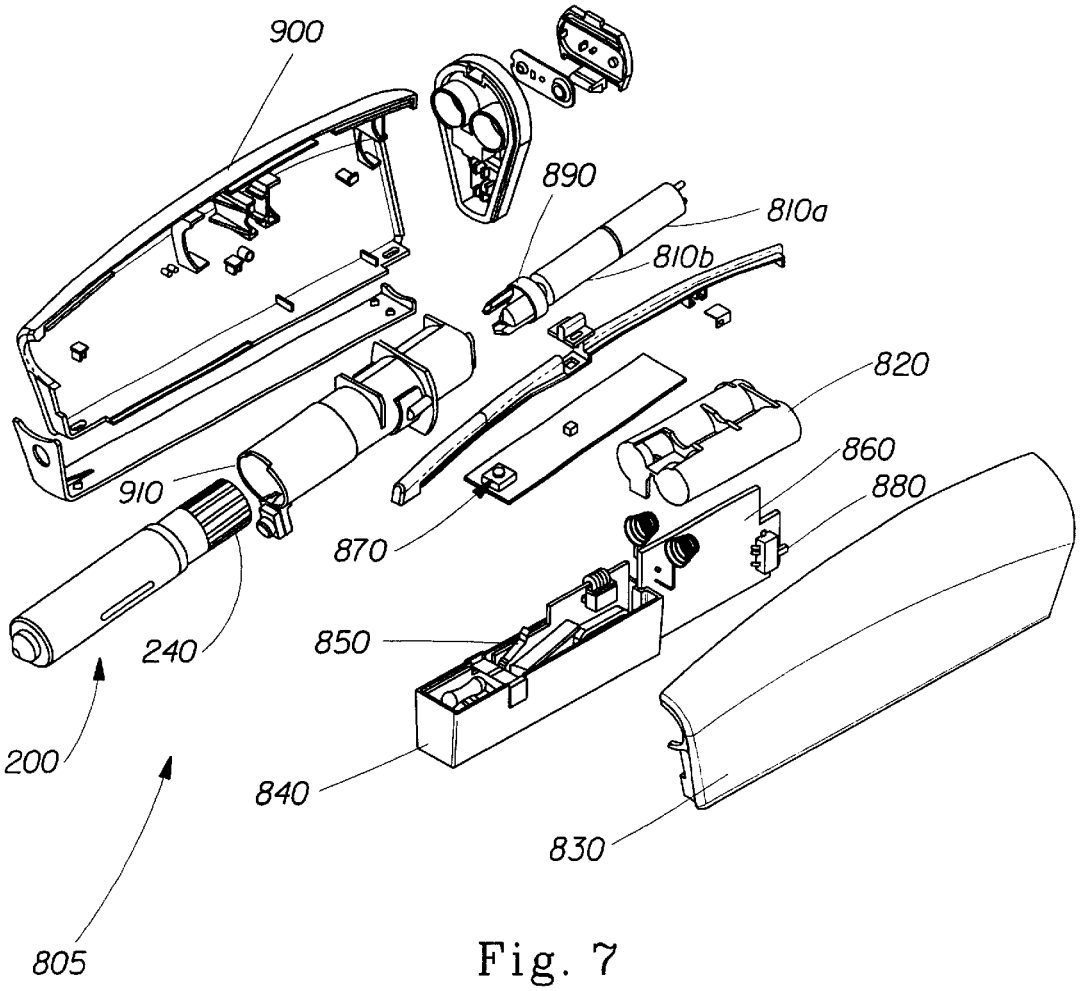
FIG. 7 is an exploded isometric view of a hand-held, self-contained electrostatic spraying device having a disposable cartridge.
Figure 8:
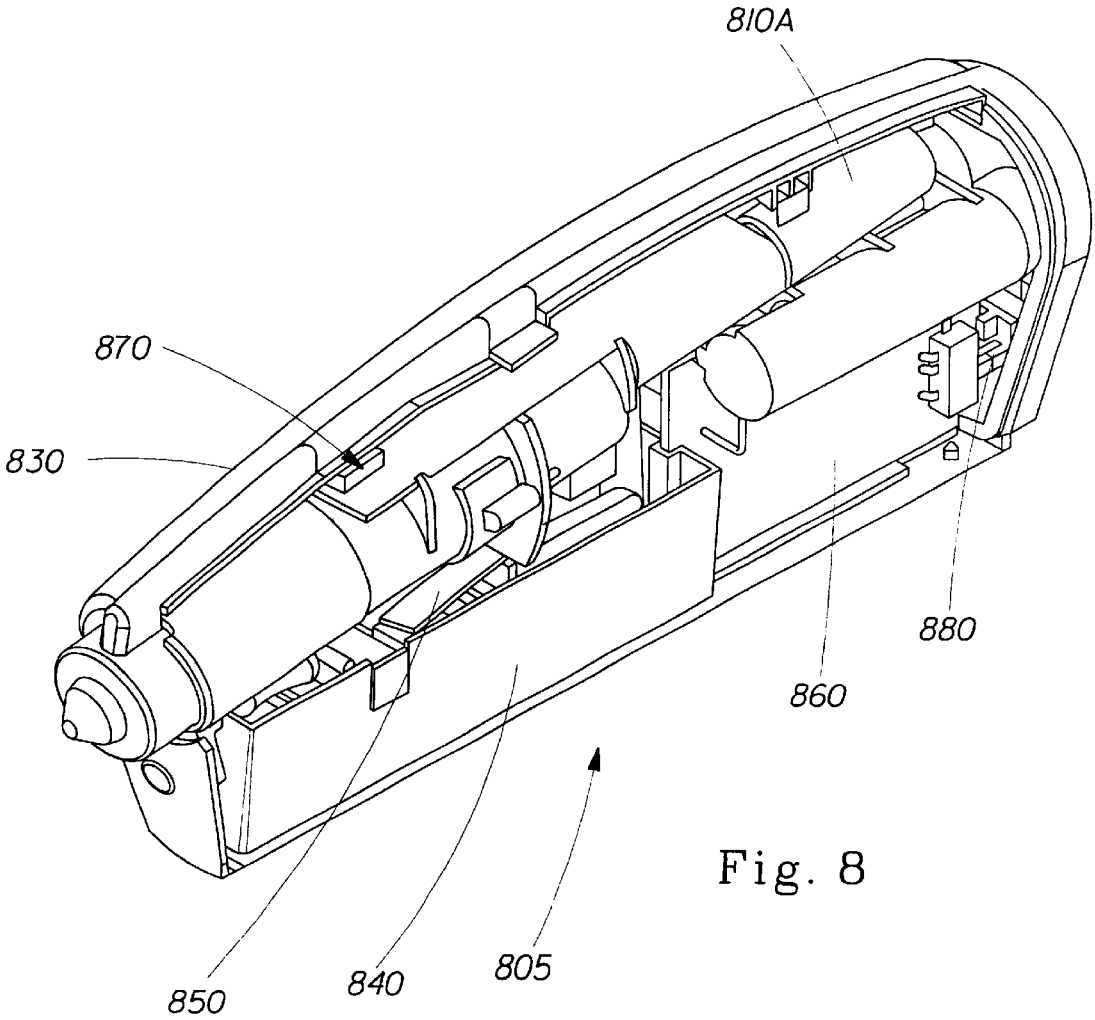
FIG. 8 is an assembled isometric view of the device within FIG. 7.

Referring to FIGS. 7 and 8, a hand-held, self-contained electrostatic spraying device 5 having a disposable cartridge 200 is shown. Disposable cartridge 200 may contain a variety of product, including but not limited to, cosmetics, skin creams, and skin lotions. The product in disposable cartridge 200 may be positively discharged (discussed supra) and powered by gearbox/motor component 10. Gearbox/motor component 10 may be fixed onto a left or first housing 30. The gearbox/motor component 10 can be affixed into place by either mechanically, adhesively, or by any other suitable technique. Gearbox/motor component 10 preferably comprises a precision motor 10*a* connected to a gearbox 10*b*. Power source 20 provides power which ultimately operates precision motor 10*b*. Examples for suitable power source 20 include, but is not limited to, two "AAA" type batteries. The power from power source 20 is channeled through circuit control 60 and high voltage power supply 40, and then to high voltage contact 50 where it comes into contact disposable cartridge 200. High voltage power supply 40 is powered and controlled by control circuit 60 (discussed infra). Power-on switch 80 permits the user to cause an interruption between power source 20 and circuit control 60. Power-on switch 80 is designed such that voltage is supplied to the remainder of the circuit only when switch 80 is in the "ON" or closed position. Apply switch 70 permits the user to selectively activate motor 10*a*, thereby activating the delivery and spraying of the product. Gearbox/motor component 10 has a driver 90 fastened to a shaft (not shown in FIGS. 1 & 2, see FIG. 3) of gearbox 10*b*, for example, with a set screw (not shown). Driver 90 has a number of protruding fingers, for example, three, which can fit into the matching recesses on the back of actuator 240.

Yet another aspect of this invention relates to maintaining contact between high voltage contact 850 and conductive shield 210 on disposable cartridge 200. For the class of electrostatic spraying devices with removable/replaceable product reservoirs, the ability to maintain the high voltage connection between the device itself and the disposable cartridge 200 is paramount for maintaining a consistent, steady state spray. When interruptions exists in the connection between the high voltage contact 850 and conductive shield 210 (or any other similar electrodes), spraying is interrupted and/or an undesirable spray is produced. In one embodiment, as exampled in FIG. 1, conductive shield 210 is of substantially circular geometry and has an annular electrode contact portion 300. Annular electrode contact portion 300 improves the intimate contact between the high voltage contact 850 and conductive shield 210 which is particularly important when the product reservoir 220 is rotated or moved within device 5. Such rotation and/or movement results in a period of interrupted supply of the high voltage power source, which leads to interruptions in spray performance. The addition of annular electrode contact portion 300 helps to minimize this problem. In an alternative design (not shown), it may also be appreciated by one skilled in the art to construct the high voltage contact 850 in a substantially circular geometry in order to achieve similar results. One skilled in the art would appreciate the use of spring biasing to improve contact between the high voltage contact 850 and conductive shield 210, as exampled in FIG. 7. In FIG. 7, high voltage contact 850 is configured as a 'leaf spring' such that when a disposable cartridge 200 is loaded into device 5, the leaf spring is biased to maintain contact with conductive shield 210. In yet another embodiment which improves the intimate contact between the high voltage contact 850 and conductive shield 210 is shown in FIGS. 9 and 10, further described below.

Figure 9:
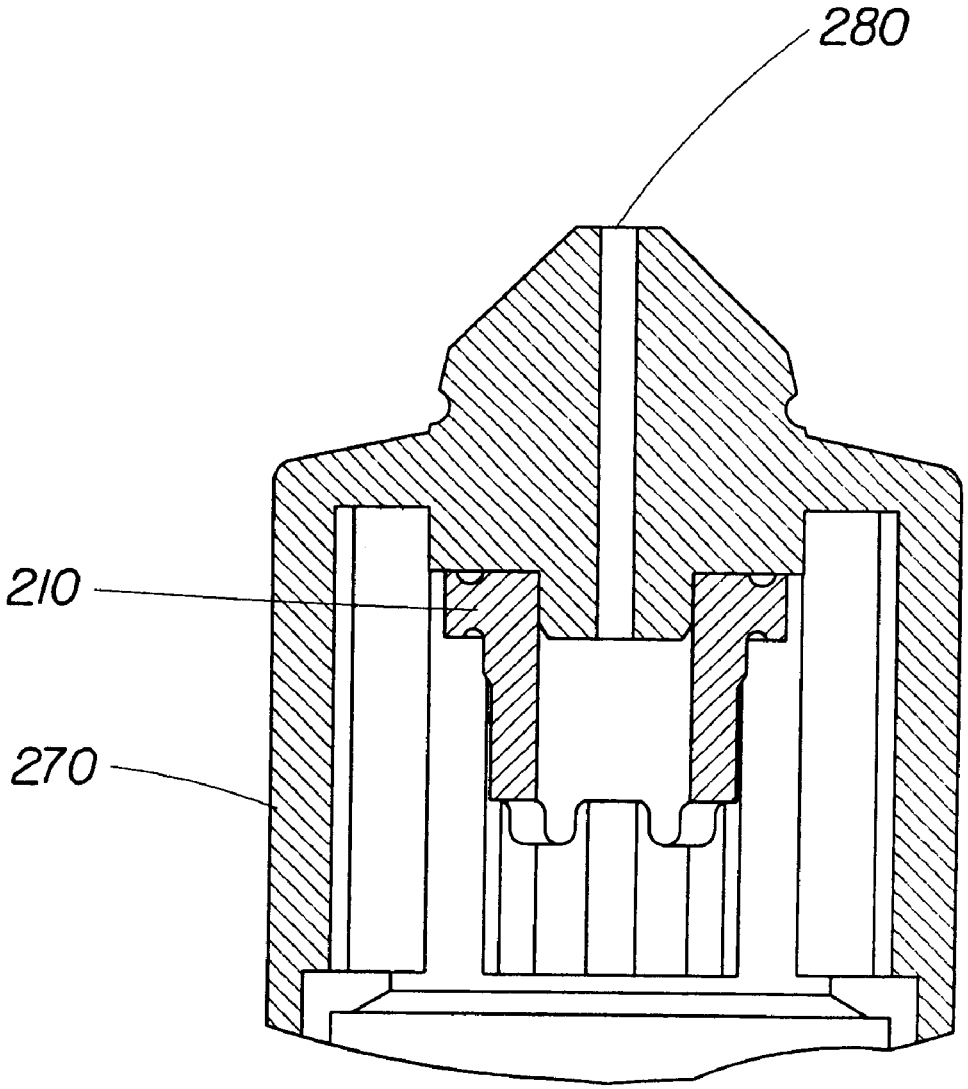
FIG. 9 is a cross-sectional view of the exiting portion of the device within FIG. 1.
Figure 10:
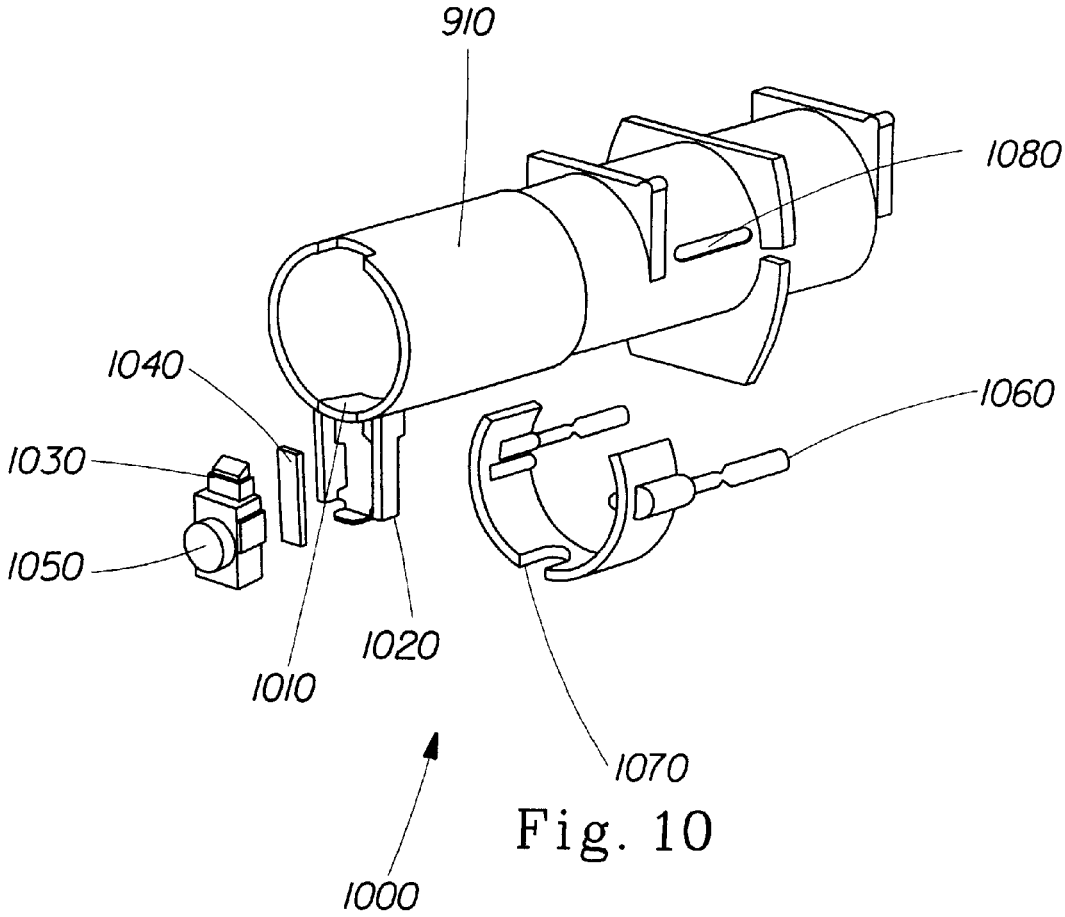
FIG. 10 is an exploded isometric view of the insert sleeve and accompanying parts within FIG. 1.

Yet another aspect of this invention, as exampled in FIGS. 9 and 10, is incorporating both locking and ejection features into disposable cartridge 200 and spraying device 805. In this embodiment, a catch mechanism 1020 is used to secure disposable cartridge 200 into insert sleeve 910 at a clasp location 1010. Catch mechanism 1020 also provides a positive tactile and audible signal to the user that disposable cartridge 200 is properly installed within device 5. Locking mechanism 1000 consists of actuator button 1050, locking slide 1030 and locking spring 1040. Locking mechanism 1000 may be connected to the underside of disposable cartridge 200 or any other suitable location. Locking slide 1030 is biased in the "UP" position by locking spring 1040. When a disposable cartridge 200 is installed, locking slide 1030 is moved down and disposable cartridge 200 is placed within insert sleeve 910. When disposable cartridge 200 is completely within insert sleeve 910, locking slide 1030 will slip into locking lug 310 (shown in FIG. 1), thereby causing an audible click and securely locking disposable cartridge 200 inside of insert sleeve 910. Actuator 240 moves electrode cover 1070 in the same direction of disposable cartridge 200 insertion, thereby exposing high voltage contact 850 (not shown in FIG. 10) inside of device 5. Electrode cover 1070 may be mounted within and guided back by slide channel 1080. While moving back, electrode cover 1070 compresses bias spring 1060. When a user desires to remove disposable cartridge 200 from insert sleeve 910, the user actuates actuator button 1050 to move locking slide 1030 down, thereby disengaging it from locking lug 310. Disposable cartridge 200 is then moved forward within insert sleeve 910 by the decompression of bias spring 1060. The user can then finish removing disposable cartridge 200 from device 5. Once installed and secured in place, locking mechanism 1000 will prevent disposable cartridge 200 from being inadvertently removed through shaking and handling of device 5 during usage and storage.

Having shown and described the preferred embodiments of the present invention, further adaptions of the present invention as described herein can be accomplished by appropriate modifications by one of ordinary skill in the art without departing from the scope of the present invention. Several of these potential modifications and alternatives have been mentioned, and others will be apparent to those skilled in the art. For example, while exemplary embodiments of the present invention have been discussed for illustrative purposes, it should be understood that the elements described will be constantly updated and improved by technological advances. Accordingly, the scope of the present invention should be considered in terms of the following claims and is understood not to be limited to the details of structure, operation or process steps as shown and described in the specification and drawings.

Incorporation by Reference:

Relevant electrostatic spray devices and cartridges are described in the following commonly-assigned, concurrently-filed U.S. patent applications, and hereby incorporated by reference:

"Electrostatic Spray Device", filed as application Ser. No. 09/759,552, which is assigned Attorney Docket No. 8394.

"Electrostatic Spray Device", filed as application Ser. No. 09/759,551, which is assigned Attorney Docket No. 8395.

"Electrostatic Spray Device", filed as application Ser. No. 09/759,550, which is assigned Attorney Docket No. 8396.

What is claimed is:

1. A cartridge configured to contain and deliver a product for use with an electrostatic spray device comprising:

a reservoir configured to contain the product;

a nozzle to disperse the product, said nozzle having an exit orifice;

a channel disposed between said reservoir and said nozzle, wherein said channel permits the electrostatic charging of the product upon said product moving within said channel;

a high voltage contact for receiving power from the electrostatic device;

a high voltage electrode electrically connected to said high voltage contact, said high voltage electrode being configured to charge the product for dispersal from said nozzle;

a high voltage shield substantially surrounding said reservoir, said high voltage shield being conductive;

a mixing mechanism disposed between said reservoir and said nozzle, said mixing mechanism being in fluid communication with the product, whereby said mixing mechanism reconstitutes the product.

2. The cartridge of claim 1, wherein said mixing mechanism is at least one mixing ball.

3. The cartridge of claim 1, wherein said mixing mechanism is at least one static mixer.

4. The cartridge of claim 1, wherein said mixing mechanism is at least one disc having at least one hole.

5. The cartridge of claim 4, wherein a plurality of said discs are arranged such that their respective hole are not axially aligned in order to increase turbulent mixing.

6. The cartridge of claim 4, wherein said hole has a diameter of approximately 0.030 inches.

7. The cartridge of claim 1, wherein said mixing mechanism is at least one baffle having at least one opening.

8. The cartridge of claim 7, wherein a plurality of said baffles are arranged such that their respective opening are not axially aligned in order to increase turbulent mixing.

9. The cartridge of claim 1, wherein said mixing mechanism is at least one prop mixer.

10. The cartridge of claim 9, wherein said prop mixer is a paddle; said paddle is connected to a piston, said piston is a component of said positive displacement mechanism and is disposed between said reservoir and said nozzle.

11. The cartridge of claim 9, wherein said prop mixer is a paddle; said paddle is connected to a shaft, said shaft is a component of said positive displacement mechanism and is disposed between said reservoir and said nozzle.

12. The cartridge of claim 9, wherein said prop mixer is a paddle; said paddle is unattached but yet still contained in said disposable so as to allow said prop mixer to rotate about a longitudinal axis to said disposable cartridge in response to product flow.

13. A cartridge configured to contain and deliver a product for use with an electrostatic spray device comprising:

a reservoir configured to contain the product;

a nozzle to disperse the product, said nozzle having an exit orifice;

a channel disposed between said reservoir and said nozzle, wherein said channel permits the electrostatic charging of the product upon said product moving within said channel;

a high voltage contact for receiving power from the electrostatic device;

a high voltage electrode electrically connected to said high voltage contact, said high voltage electrode being configured to charge the product for dispersal from said nozzle;

a high voltage shield substantially surrounding said reservoir, said high voltage shield being conductive, wherein said high voltage electrode is annular.

* * * * *